US011786420B2

(12) United States Patent
Küschall

(10) Patent No.: US 11,786,420 B2
(45) Date of Patent: Oct. 17, 2023

(54) DRIVE DEVICE FOR A WHEELCHAIR

(71) Applicant: Rainer Küschall, Allschwil (CH)

(72) Inventor: Rainer Küschall, Allschwil (CH)

( * ) Notice: Subject to any disclaimer, the term of this patent is extended or adjusted under 35 U.S.C. 154(b) by 494 days.

(21) Appl. No.: 16/648,914

(22) PCT Filed: Sep. 20, 2018

(86) PCT No.: PCT/EP2018/075405
§ 371 (c)(1),
(2) Date: Mar. 19, 2020

(87) PCT Pub. No.: WO2019/057799
PCT Pub. Date: Mar. 28, 2019

(65) Prior Publication Data

US 2020/0281784 A1 Sep. 10, 2020

(30) Foreign Application Priority Data

Sep. 21, 2017 (CH) ..... 01164/17

(51) Int. Cl.
*A61G 5/04* (2013.01)
*A61G 5/10* (2006.01)

(52) U.S. Cl.
CPC ..... *A61G 5/047* (2013.01); *A61G 5/042* (2013.01); *A61G 5/104* (2013.01); *A61G 5/1051* (2016.11)

(58) Field of Classification Search
CPC ..... A61G 5/047; A61G 5/042; A61G 5/1051; A61G 5/104
See application file for complete search history.

(56) References Cited

U.S. PATENT DOCUMENTS

| | | | | |
|---|---|---|---|---|
| 8,388,010 | B2 * | 3/2013 | Butts | A61G 5/047 280/250.1 |
| 9,872,805 | B2 * | 1/2018 | Bach Castillo | A61G 5/027 |
| 2001/0022244 | A1 * | 9/2001 | Takada | A61G 5/047 180/69.6 |
| 2004/0000440 | A1 | 1/2004 | Sawyer | |
| 2006/0000664 | A1 * | 1/2006 | Huang | A61G 5/1051 180/907 |

(Continued)

FOREIGN PATENT DOCUMENTS

| | | | |
|---|---|---|---|
| DE | 19935506 | A | 2/2001 |
| GB | 2539737 | A | 12/2016 |

(Continued)

OTHER PUBLICATIONS

International Search Report dated Nov. 15, 2018 in corresponding International Application No. PCT/EP2018/075405.

(Continued)

*Primary Examiner* — Minnah L Seoh
*Assistant Examiner* — Michael R Stabley
(74) *Attorney, Agent, or Firm* — MEDLER FERRO WOODHOUSE & MILLS PLLC

(57) ABSTRACT

A drive device for a wheelchair includes a control element, a chassis and a support frame. A fixing arrangement is mounted on the support frame and can be fixed to a wheelchair frame of the wheelchair. The fixing arrangement is designed such that it can be automatically connected to and released from the wheelchair frame of the wheelchair by a fixing drive.

18 Claims, 2 Drawing Sheets

(56) References Cited

U.S. PATENT DOCUMENTS

| | | | | |
|---|---|---|---|---|
| 2013/0240271 | A1* | 9/2013 | Tallino | A61G 5/1054 180/11 |
| 2015/0351979 | A1* | 12/2015 | Conte | B62B 3/0612 180/13 |
| 2018/0338877 | A1* | 11/2018 | Kano | B62K 15/00 |

FOREIGN PATENT DOCUMENTS

| | | | |
|---|---|---|---|
| WO | 2015/040507 | A2 | 3/2015 |
| WO | 2017/081475 | A1 | 5/2017 |

OTHER PUBLICATIONS

European Office Action issued in corresponding European Application No. 18782653.2 dated Oct. 18, 2022.

* cited by examiner

DRIVE DEVICE FOR A WHEELCHAIR

TECHNICAL FIELD

The present invention falls within the field of drive mechanisms for personal transport means specially designed for sick or disabled persons, in particular wheelchairs and the like. According to the preamble of claim 1, the invention relates to a drive device for a wheelchair comprising a control element, a chassis and a support frame, wherein a fixing arrangement is mounted on the support frame and can be fixed to a wheelchair frame of the wheelchair.

BACKGROUND

Drive devices for wheelchairs are known in many different embodiments, wherein in principle a distinction can be made between drive devices that are fixedly connected to the wheelchair and drive devices that are releasable. What all releasable drive devices have in common is that they are only connected to a wheelchair when required and that otherwise the wheelchair is substantially free of mostly bulky construction or drive elements for manual operation, which are also correspondingly heavy.

A drive device for a wheelchair is known from WO 2017/081475 A1, in which drive device on the one hand, a hook engages a foot support of the wheelchair and on the other hand, two support arms are connected to frame tubes of the wheelchair in such a manner that the drive device is attached to the wheelchair by gravity.

The document WO 2015/040507 A2 discloses a drive device for a wheelchair, which has a handlebar and fork blades connected thereto, between which a drive wheel with a motor which can be fed from a power supply is arranged, wherein the drive device has a clamping device on a clamping strut, which clamping device can be clamped to a frame tube of the wheelchair. The clamping device present here has two clamping segments which, in a closed position, engage in one another via a latching nose on the one clamping segment and via a hook on the other clamping segment, wherein this clamping device is fixable in this closed position via a manually operable lever.

This known prior art involves the necessity of manually attaching or mounting the drive units to the wheelchair, for which an appropriate degree of skill and mobility is a basic requirement. Although these conventional drive units can be mounted on a wheelchair for comparatively highly mobile persons, the demands on skill and mobility for mounting or dismounting by a user of the wheelchair can exceed the extent to which he or she is even capable of doing. Consequently, such drive units cannot be used independently by the user, which limits his or her independence and possibly may make an assistant absolutely necessary for mounting or dismounting.

It is therefore an object of the present invention to propose a drive device for a wheelchair which enables independent and simple mounting or dismounting on a conventional wheelchair.

SUMMARY OF THE INVENTION

The object is achieved according to the invention by a drive device as defined in independent claim 1. Advantageous embodiments of the invention are apparent from the dependent claims.

The essence of the invention is as follows: A drive device for a wheelchair comprises a control element, a chassis and a support frame. A fixing arrangement is mounted on the support frame and can be fixed to a wheelchair frame of the wheelchair. The fixing arrangement is designed such that it can be automatically connected to and released from the wheelchair frame by means of a fixing drive. The drive device can be a pulling device which is pretensioned by the fixing arrangement to pull the wheelchair. Or it can also be a pushing device, which is mounted on the back of the wheelchair.

The term "chassis" refers to those parts of the drive device which serve as a movable connection to a ground or road surface. The chassis may have a fork or wheel suspension and a drive wheel mounted thereon, a caterpillar construction or a similar mechanism.

The term "automatically" in the context of the invention refers in particular to a connecting or releasing without the need for manual manipulation. The fixing process itself can thus be carried out without manual intervention. Triggering the fixing drive/fixing process or stopping the fixing drive/fixing process can still be carried out manually without it no longer being an automatic connection or release. For example, the drive device can be automatically connected to the wheelchair by positioning it correctly on the wheelchair, manually actuating a switch and thereby starting the fixing drive and fixing the wheelchair frame by means of the fixing arrangement without manual intervention.

The fixing arrangement can be designed in different ways, for example as a hooking construction or as a clamping device. As a clamping device it can be clamped to a tube or a similar part of the wheelchair frame.

Thus, according to the invention, the fixing drive connects the fixing arrangement and thus the drive device to the wheelchair without the need for a user of the wheelchair to bend forward or even manually operate a locking device. The fixing arrangement with fixing drive according to the invention significantly increases the user's independence and freedom of movement, since the assistance of another person is not necessary. The fixing arrangement can also be advantageous for more mobile users, as it enables comfortable and safe mounting and dismounting on the wheelchair.

A further advantage of the invention is that by means of the present automatic fixing arrangement a wide range of different thicknesses of frame tubes is provided and no proprietary adjustments between the drive device and the wheelchair have to be carried out.

In addition, it is of advantage that the drive device does not need to be equipped with any additional components for the connection to the wheelchair. Rather, according to the invention, the fixing arrangement acts directly on the wheelchair frame. Thus, the wheelchair can remain handy and light when the drive device is not connected to it.

The chassis can be operated in different ways. In one possible embodiment, it can be operated by means of hand pedals, which, for example, are connected to the chassis or a drive wheel thereof through a chain. However, as an alternative or in addition, the drive device preferably comprises a motor and a power supply, wherein the motor can be fed from the power supply and is connected to the chassis. Such a motor enables the wheelchair to be conveniently driven automatically. In combination with the mentioned hand pedals, the drive device can be designed similar to an eBike. Such eBike-type drive devices can enable a combined automatic and (partially) manual operation.

Preferably, the fixing drive includes a fixing motor. The fixing motor can be a locking motor or a clamping motor. It can be designed as a linear motor. Such a fixing motor enables an efficient, convenient and safe functioning of the fixing drive. The fixing motor is preferably designed to be fed from the energy supply. In this way, the energy supply, such as a battery of the motor or drive motor, can also be used specifically for the fixing motor during mounting or dismounting. Because specifically batteries are typically relatively heavy components of drive devices, additional batteries or power supplies for driving the fixing motor can be omitted and the weight of the drive device can therefore be kept relatively low.

In an advantageous further development of the invention, the drive device comprises a switching element which is connected to the fixing drive. The switching element can be designed as a pushbutton, a button, a switch or similar. It can also be a piezoelectric component, for example, which can be activated without any contacting taking place. The switching element can be used to actuate the fixing drive or to switch it on and/or off. For this purpose, the switching element is advantageously placed within easy reach of the wheelchair user, for example on the handlebars, and is therefore easily accessible.

The fixing arrangement preferably comprises a first and a second clamping jaw, which are connected to the fixing drive and to each other on one side via a joint. The fixing drive is preferably arranged around the joint for moving the first and second clamping jaws towards each other. By means of such clamping jaws, the fixing arrangement can be designed in an advantageous way as a clamping device. This enables a safe and efficient fixing of the drive device to the wheelchair frame. In particular, different tube thicknesses or tube shapes can be fixed using the same clamping jaws, so that the drive device can be automatically fixed to different wheelchairs.

Preferably, the drive device has a contact element that is connected to the fixing drive and is arranged in such a way that it can be activated by the wheelchair frame when the latter is positioned as intended. In connection with the wheelchair frame, the term "positioned as intended" can refer to the fact that the wheelchair frame is arranged in a position suitable for connection to the drive device. The contact element enables the fixing arrangement or the fixing drive to be automatically released simply by a suitable arrangement of the wheelchair. The contact element can be designed as a pushbutton, a button, a switch or similar. It can also be a piezoelectric component, for example, which can be activated without any contacting taking place. In the case of a design of the fixing arrangement with clamping jaws, the contact element is preferably a switching pin arranged between the clamping jaws, which can be brought into an operative connection with the wheelchair frame when the drive device is attached to the wheelchair. In this way a particularly simple mounting between the wheelchair and the drive device is possible. To release the drive device, the switching element can be actuated and the fixing arrangement opens and releases the wheelchair.

The fixing arrangement preferably comprises a control unit or a controller connected to the fixing drive, wherein the controller stops the fixing drive when a clamping pressure between the clamping jaws and the wheelchair frame reaches a predefined value and/or the closing of the clamping jaws does not continue for a predefined period of time. In connection with the closing of the clamping jaws, the term "does not continue" is understood to mean a termination of the closing movement, which can occur, for example, when the clamping jaws rest against a part of the wheelchair frame. With the controller mentioned above, the clamping jaws can, for example, clamp a frame tube and stop the increasing clamping as soon as the force of the motor is no longer able to press the clamping jaws any further towards one another or when they have a certain clamping pressure. This makes it possible, among other things, to securely connect frame tubes of different diameters or different shapes with the same clamping jaws or the same fixing arrangement. It is also possible to apply sufficient clamping force to securely fix a frame tube.

Each of the two clamping jaws preferably has two straight clamping jaw segments and, between these straight clamping jaw segments, has a connecting, angled clamping jaw segment for distinct positioning of the wheelchair frame between the clamping jaws. The term "angled" in this context may refer to a folded, curved, bent or similar shape. Due to this design of the clamping jaws, the frame tube is always in a predetermined position near the bent clamping jaw segment during the closing process and is always aligned in the same way to the clamping jaws.

Preferably, the fixing arrangement is designed in such a way that the wheelchair frame is automatically lifted when connecting the drive device. In particular, this lifting can refer to a region of the wheelchair where its front wheels are mounted. Such lifting can, for example, take place in a range of between about 2 cm to about 8 cm. This allows the front wheels of the wheelchair to be lifted off the ground. The whole structure then stands on the rear wheels of the wheelchair and the chassis of the drive device. This allows the wheelchair to have the necessary front wheel clearance and enables efficient driving with the wheelchair.

The support frame may have a tubular construction and a base. The base can be connected to the chassis, for example by means of a pivotable or rotatable connection. Preferably, the support frame has a stand portion that can be placed on a ground surface when the drive device is not connected to the wheelchair frame of the wheelchair. In addition, the support frame is preferably height-adjustable. This allows the drive device to be adjusted to suit the user.

The chassis is preferably hinged to the support frame so that a distance between the chassis and the support frame can be changed. By changing this distance—with the drive device attached to the wheelchair—a distance between the chassis or drive wheel and the wheelchair or its rear wheels can be changed at the same time. In this way, the wheelchair can be lifted efficiently. Changing the distance can be achieved, for example, by moving the chassis a little towards the wheelchair. For example, a drive wheel can roll backwards a little while the rear wheels of the wheelchair are blocked.

The support frame is preferably equipped with a blocking structure that allows the chassis to be blocked in a plurality of blocking positions relative to the support frame, wherein the distance between the chassis and the support frame is different in the plurality of blocking positions.

The fixing arrangement preferably comprises a pulling element and a pretensioning device which are designed to pull the chassis towards the wheelchair after the fixing arrangement has connected the wheelchair frame. Such a configuration allows a relatively simple and safe automatic lifting of the wheelchair frame or wheelchair.

In a preferred design, the fixing arrangement is designed to be connected to a front region of the wheelchair frame. The front region of the wheelchair frame is understood to be the region facing a front side of the wheelchair or forming such a front side. Typically, the front region of the wheelchair frame is designed to accommodate or support the user's feet and lower legs. The front part of the wheelchair frame can comprise one or more quasi-vertical or slightly inclined front frame tubes. When in use, the front frame tubes can run more or less along the user's lower legs. Such a configuration of the fixing arrangement allows a simple and efficient connection of the drive device to the wheelchair.

Preferably, the fixing arrangement is designed to be connectable to a frame tube of the wheelchair frame. In particular, the frame tube can be one of the two front frame tubes mentioned above. In other words, the frame tube of the wheelchair frame is preferably a quasi-upright front frame tube of the wheelchair frame. The term "quasi-upright" can be understood to mean an exact or more or less or substantially vertical alignment of the front frame tube. In this way, the drive device can be mounted on the wheelchair from the front in an efficient way and thus be used as a pulling device.

The drive device is preferably configured to be positioned in front of the wheelchair when the fixing arrangement is fixed to the wheelchair frame. In this way, the drive device can be designed as a pulling device, which enables the wheelchair to be driven efficiently and safely.

In this case, for example by predefined positioning of the front frame tube in the clamping jaws, a tube axis associated with the front frame tube can enclose, in the mounted state of the drive device, a first angle with respect to a road surface which is smaller than a second angle in the unmounted state of the drive device. In this way, the front frame tube and with it an associated portion of the wheelchair frame can be lifted, whereby the front wheels of the wheelchair can be lifted off the ground and the driving characteristics of the driven wheelchair, which then rests on the road surface only with the rear wheels and the chassis, can be improved.

For lifting the front wheels of the wheelchair, which typically are stationarily fixed to the frame tube, the drive device may also be equipped with a separate device in addition to the above-mentioned configuration of the clamping jaws or the above-mentioned configuration with an hinged chassis. For example, the front frame tube or the front wheels can be lifted by means of a manual lifting device. Such a manual lifting device may, for example, comprise a drawbar or rope which is attached to the drive device and which, once the drive device is connected to the wheelchair, is pulled and attached or hooked onto the wheelchair.

BRIEF DESCRIPTION OF THE DRAWINGS

In the following, the invention is explained by way of example with reference to the figures. Identical objects in the figures are principally designated by identical reference signs. At this point, it is pointed out that the figures do not have any limiting effect on the subject matter of the invention, but merely represent possible embodiments of the inventive idea. In the figures.

DETAILED DESCRIPTION

Figure 1:
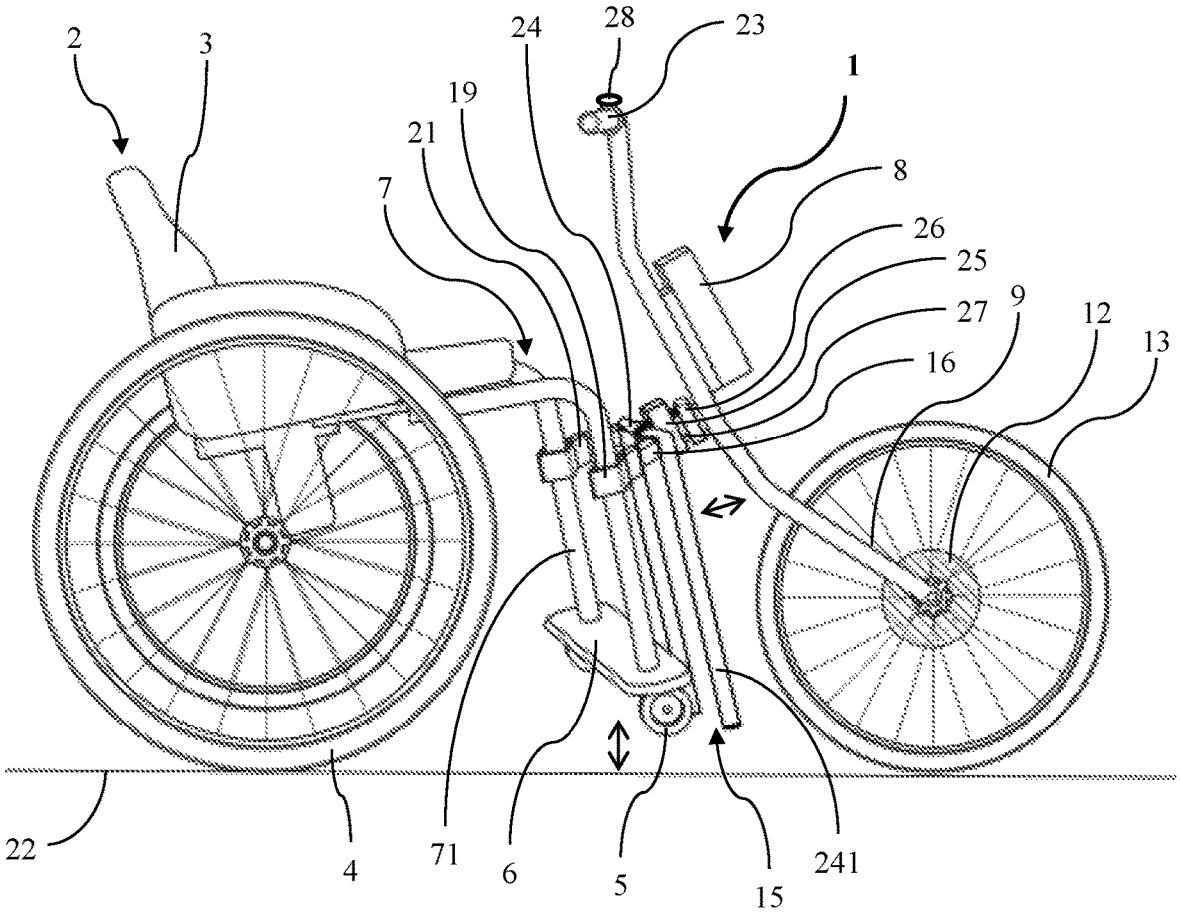
FIG. 1 shows a drive device according to the invention for a wheelchair.

Certain expressions are used in the following description for practical reasons and are not to be understood in a limiting sense. The words "right", "left", "bottom" and "top" indicate directions in the drawing to which reference is made. The terms "inwards", "outwards", "below", "above", "left", "right" or the like are used to describe the arrangement of designated parts relative to each other, the movement of designated parts relative to each other and the directions towards or away from the geometrical center of the invention and the designated parts of the same as shown in the figures. These spatial relative indications also include other positions and orientations than those shown in the figures. For example, if a part shown in the figures is turned over, elements or features described as "below" are then "above". The terminology includes the words explicitly mentioned above, derivatives of the same and words of similar meaning.

In order to avoid repetitions in the Figs. and the associated description of the various aspects and exemplary embodiments, certain features should be understood as common to different aspects and exemplary embodiments. The omission of an aspect in the description or in a Fig. does not imply that this aspect is missing in the associated exemplary embodiment. Rather, such omissions can serve to clarify and prevent repetitions. In this context, the following definition applies to the entire further description: If a figure contains reference signs for the purpose of graphic clarity, but these are not mentioned in the directly associated description text, reference is made to their explanation in previous descriptions of the figures. If, in addition, reference signs are mentioned in the description text directly associated with a figure, but are not included in the figure itself, reference is made to the preceding and following figures. Similar reference signs in two or more Figs. represent similar or identical elements.

FIG. 1 shows a drive device 1 according to the invention, as it is mounted on a conventional wheelchair 2 by means of a clamping device 19 as a fixing arrangement on the front frame tubes 71 of a wheelchair frame 7 of the wheelchair 2 without components fixedly attached to the wheelchair frame 71. At their lower ends, the front frame tubes 71 are connected to each other via a footrest 6. On the underside, two small front wheels 5 are arranged on the footrest 6. A seat 3 is stationarily mounted on the wheelchair frame 7. The wheelchair 2 comprises two large rear wheels 4 which are mounted to be rotatable in relation to the wheelchair frame 7.

The drive device 1 comprises a handlebar 23 and a chassis connected thereto which comprises fork blades 9 of a fork connected to the handlebar 23 and a drive wheel 13 mounted between the fork blades 9. A drive motor 12, which is fed from a battery 8 as energy supply, is arranged in the hub of the drive wheel.

Furthermore, the drive device 1 has a support frame 15, which is equipped with the clamping device 19. The support frame 15 comprises a quasi-U-shaped base 24, the lower ends of which form a stand portion 241. In the unmounted state, the two ends of the base 24 of the support frame 15 stand on a ground surface 22. Thus, the support frame 15 can serve as a stand for the drive device 1 when it is detached from the wheelchair 2.

The support frame 15 further comprises a block 25, which is stationarily connected to a cross strut of the base 24 and to which a steering joint 26 is hinged. At the top, the steering joint 26 is connected to the block 25 in a rotatable or pivotable manner and at the bottom via a linkage 27 of a blocking structure. The linkage 27 can be locked in various longitudinal positions on the block 25. Thereby, a different angle of rotation between steering joint 26 and block 25 can be fixed in the plurality of positions. In this way, a distance between the drive wheel 13 and the support frame 15 can be adjusted. In particular, by decreasing this angle, the drive wheel 13 can be pulled closer to the support frame and thus the front wheels 241 of the wheelchair 2 can be lifted off the ground 22.

Figure 2A:
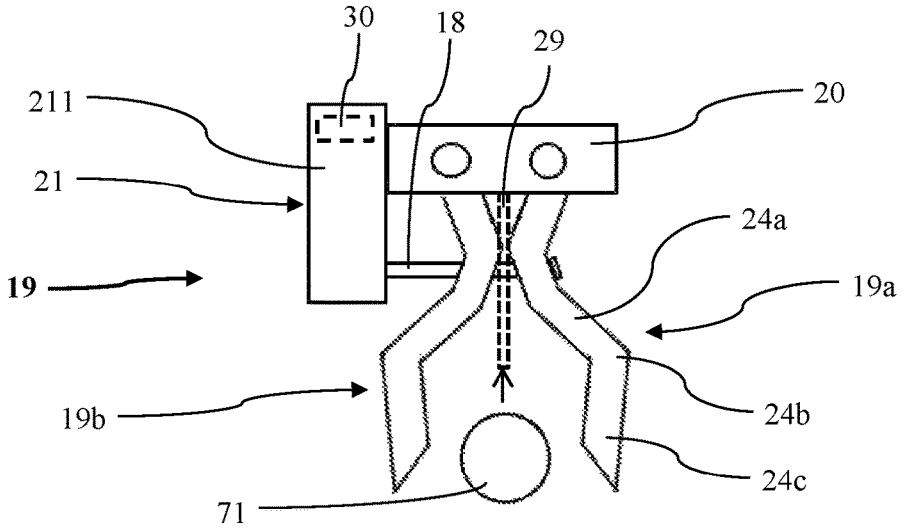
FIGS. 2*a* and 2*b* show a clamping device as an exemplary embodiment of a fixing arrangement of the drive device of FIG. 1 in an open and a closed state.
Figure 2B:
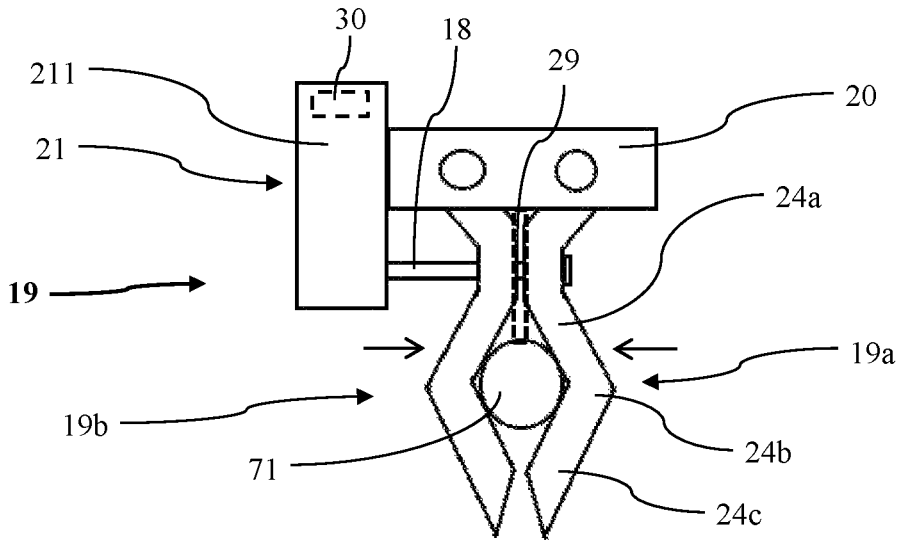

In FIGS. 2*a* and 2*b*, the clamping device 19 is illustrated in more detail. In particular, it has two pairs of clamping jaws 19*a*, 19*b*, each connected to a clamping drive 21 as a fixing drive, wherein for a better overview only one pair of clamping jaws 19*a*, 19*b* of the clamping device 19 is shown as an example in FIGS. 2*a* and 2*b*, namely, on the one hand in an open state and on the other hand in a closed state. The clamping drives 21 each comprise a clamping motor 211, both of which are likewise fed from the power supply 8 and are actuated or activated by means of a button 28 as a switching element arranged on the handlebar 23. As an alternative it is also possible to provide a single clamping motor 211 which moves both pairs of clamping jaws 19*a*, 19*b*. Alternatively to the button 28, switching pins 29 (depicted in hashed lines) may be arranged between the clamping jaws 19*a*, 19*b* as contact elements, which are contacted by the front frame tubes 71 to automatically operate the clamping drive 21. For automatically stopping the clamping drive 21, when a clamping pressure between the clamping jaws 19*a*, 19*b* and the front tubes 71 reaches a predefined value, the clamping device 19 may be provided with a respectively configured controller 30 (depicted in hashed lines).

The clamping jaws 19*a,b*, are connected to each other at one end via a clamping joint 20. As shown in FIG. 1, the clamping motor 211 is arranged on a strut 16 of the support frame 15. Similar to an angle iron, the clamping jaws 19*a,b* have three clamping jaw segments 24*a,b,c*. These are in particular two straight clamping jaw segments 24*a,c* which are connected to each other via a bent clamping jaw segment 24*b*.

To connect the drive unit 1 to the wheelchair 2, a user of the wheelchair 2 drives towards the drive device 1 until the two front frame tubes 71 are between the two clamping jaws 19*a*, 19*b* of a pair. By actuating the button, the clamping motors 211 move the clamping jaws 19*a*, 19*b* of the clamping device 19 towards each other, so that they securely fix the two front frame tubes 71.

When feeding the drive mechanism 1 to the frame tube 7 with the clamping jaws 19*a,b* open, see FIG. 2*a*, the button can be actuated, which activates the clamping drive 21 or the clamping motor 211. In doing so, the clamping motor 211 retracts a spindle 18 mounted on the clamping jaws 19*a,b* so that the clamping jaws 19*a,b* are moved towards each other. The clamping drive 21 is equipped with a controller that is designed to stop the movement of the clamping jaws 19*a,b* if there is no movement for a predefined time. The clamping jaws 19*a,b* are then held in this state and the front frame tube 71 is firmly clamped and fixed, see FIG. 2*b*.

Although the invention is illustrated and described in detail by means of the figures and the associated description, this illustration and this detailed description are to be understood as illustrative and exemplary and not as limiting the invention. In order not to idealize the invention, in certain cases well known structures and techniques may not be shown and described in detail. It is understood that those skilled in the art can make changes and modifications without departing from the scope of the following claims. In particular, the present invention covers further exemplary embodiments with any combinations of features which may differ from the explicitly described combinations of features.

The present disclosure further comprises embodiments with any combination of features mentioned or shown above or below for different embodiments. It also comprises individual features in the figures, even if they are shown there in connection with other features and/or are not mentioned above or below. Furthermore, the alternatives of embodiments described in the figures and the description and individual alternatives of their features may be excluded from the subject matter of the invention or the disclosed subject matter. The disclosure comprises embodiments which exclusively comprise the features described in the claims or in the exemplary embodiments as well as those which comprise additional other features.

Furthermore, the term "comprise" and derivatives thereof do not exclude other elements or steps. Likewise, the indefinite article "a" and derivatives thereof do not exclude a plurality. The functions of a plurality of features listed in the claims may be fulfilled by a unit or a step. The terms "substantially", "about" "approximately", "quasi" and the like in connection with a characteristic or a value also define in particular exactly the characteristic or exactly the value. The terms "about", "quasi" and "approximately" in connection with a given numerical value or range can refer to a value or range which lies within 20%, within 10%, within 5% or within 2% of the given value or range.

What is claimed is:

1. A pulling device for a wheelchair, comprising:
- a control element;
- a chassis;
- a support frame; and
- a fixing arrangement mounted on the support frame,
- wherein the fixing arrangement is fixable to a wheelchair frame of the wheelchair,
- wherein the pulling device is configured to be positioned in front of the wheelchair when the fixing arrangement is fixed to the wheelchair frame of the wheelchair, and to be pretensioned by means of the fixing arrangement for pulling the wheelchair,
- wherein the fixing arrangement is arranged to be automatically connected to and released from the wheelchair frame of the wheelchair by a fixing drive,
- wherein the fixing arrangement is designed to be connected to a frame tube of the wheelchair frame of the wheelchair, and
- wherein the fixing arrangement is designed to be connected to a front region of the wheelchair frame of the wheelchair.

2. The pulling device according to claim 1, further comprising:
- a drive motor; and
- a power supply,
- wherein the drive motor can be fed from the power supply and is connected to the chassis.

3. The pulling device according to claim 2, wherein the fixing drive has a fixing motor.

4. The pulling device according to claim 3, wherein the fixing motor is designed to be fed by the power supply.

5. The pulling device according to claim 1, further comprising a switching element connected to the fixing drive.

6. The pulling device according to claim 1, wherein the fixing arrangement comprises a first clamping jaw and a second clamping jaw, which are connected to the fixing drive and to one another on one side via a joint.

7. The pulling device according to claim 6, wherein the fixing drive is arranged around the joint for moving the first and second clamping jaws towards each other.

8. The pulling device according to claim 6, wherein the fixing arrangement comprises a controller which is connected to the fixing drive, wherein the controller stops the fixing drive when a clamping pressure between the first and second clamping jaws and the wheelchair frame reaches a predefined value and/or when closing of the first and second clamping jaws does not continue for a predefined period of time.

9. The pulling device according to claim 6, wherein each clamping jaw substantially comprises two straight clamping jaw segments and, between the straight clamping jaw segments, a connecting, angled clamping jaw segment for the purpose of distinct positioning of the wheelchair frame between the first and second clamping jaws.

10. The pulling device according to claim 1, wherein the support frame has a stand portion which can be placed on a ground surface when the pulling device is not connected to the wheelchair frame of the wheelchair.

11. The pulling device according to claim 1, wherein the support frame is designed to be adjustable in height.

12. The pulling device according to claim 1, wherein the fixing arrangement is designed such that the wheelchair frame of the wheelchair is automatically lifted when connecting the pulling device.

13. The pulling device according to claim 12, wherein the fixing arrangement comprises a pulling element and a pretensioning device which are designed to pull the chassis towards the wheelchair after the fixing arrangement has connected the wheelchair frame of the wheelchair.

14. The pulling device according to claim 1, wherein the chassis is hinged on the support frame so that a distance between the chassis and the support frame can be changed.

15. The pulling device according to claim 14, wherein the support frame is equipped with a blocking structure with which the chassis can be blocked in a plurality of blocking positions relative to the support frame, wherein the distance between the chassis and the support frame is different in the plurality of blocking positions.

16. A pulling device for a wheelchair comprising:

a control element;

a chassis;

a support frame;

a fixing arrangement mounted on the support frame, wherein the fixing arrangement is fixable to a wheelchair frame of the wheelchair, wherein the pulling device is configured to be positioned in front of the wheelchair when the fixing arrangement is fixed to the wheelchair frame of the wheelchair, and to be pretensioned by means of the fixing arrangement for pulling the wheelchair, wherein the fixing arrangement is arranged to be automatically connected to and released from the wheelchair frame of the wheelchair by a fixing drive, and wherein the fixing arrangement is designed to be connected to a frame tube of the wheelchair frame of the wheelchair, wherein the fixing arrangement comprises a first clamping jaw and a second clamping jaw, which are connected to the fixing drive and to one another on one side via a joint and a contact element connected to the fixing drive and arranged to be activatable by the wheelchair frame when the wheelchair frame is positioned as intended.

17. The pulling device according to claim 16, wherein the contact element is a switching pin which is arranged between the first and second clamping jaws and which can be brought into operative connection with the wheelchair frame of the wheelchair when attaching the pulling device to the wheelchair.

18. A pulling device for a wheelchair comprising:

a control element;

a chassis;

a support frame; and a fixing arrangement mounted on the support frame, wherein the fixing arrangement is fixable to a wheelchair frame of the wheelchair, wherein the pulling device is configured to be positioned in front of the wheelchair when the fixing arrangement is fixed to the wheelchair frame of the wheelchair, and to be pretensioned by means of the fixing arrangement for pulling the wheelchair, wherein the fixing arrangement is arranged to be automatically connected to and released from the wheelchair frame of the wheelchair by a fixing drive, wherein the fixing arrangement is designed to be connected to a frame tube of the wheelchair frame of the wheelchair, and wherein the frame tube of the wheelchair frame of the wheelchair is a quasi-upright front frame tube of the wheelchair frame of the wheelchair.

* * * * *